US007614198B1

(12) United States Patent
Piskula et al.

(10) Patent No.: US 7,614,198 B1
(45) Date of Patent: Nov. 10, 2009

(54) METHOD FOR PROVIDING EXISTING BUILDING FLAT ROOF WITH DRAIN RESTRICTORS

(76) Inventors: James S. Piskula, 17365 Holly La., Brookfield, WI (US) 53045; James F. Mickowski, 500 W. Bradley Rd., Fox Point, WI (US) 53217

( * ) Notice: Subject to any disclaimer, the term of this patent is extended or adjusted under 35 U.S.C. 154(b) by 0 days.

(21) Appl. No.: 11/761,696

(22) Filed: Jun. 12, 2007

Related U.S. Application Data

(63) Continuation of application No. 10/834,586, filed on Apr. 29, 2004, now abandoned.

(51) Int. Cl.
*E04F 17/00* (2006.01)

(52) U.S. Cl. ..... 52/741.1; 52/302.7; 52/302.1; 210/163

(58) Field of Classification Search ..... 52/302.7, 52/302.1, 164, 166, 741.1; 210/163, 164; 4/654, 679, 686, 286
See application file for complete search history.

(56) References Cited

U.S. PATENT DOCUMENTS

| | | | | | |
|---|---|---|---|---|---|
| 528,888 | A | * | 11/1894 | McGill | 405/43 |
| 1,593,550 | A | | 7/1926 | Holt | |
| 1,761,257 | A | * | 6/1930 | Fleming | 210/166 |
| 2,807,368 | A | * | 9/1957 | Blau | 210/463 |
| 3,357,561 | A | * | 12/1967 | Schmid et al. | 210/163 |
| 3,517,813 | A | | 6/1970 | Thaler | |
| 4,107,929 | A | | 8/1978 | Ebeling et al. | |
| 4,122,230 | A | | 10/1978 | Lowell | |
| 4,205,710 | A | * | 6/1980 | Dunicz | 141/9 |
| 4,525,273 | A | | 6/1985 | Logsdon | |
| 4,615,153 | A | | 10/1986 | Carey | |
| 4,683,685 | A | | 8/1987 | Ebeling et al. | |
| 5,051,175 | A | | 9/1991 | Walczak et al. | |
| 5,333,417 | A | | 8/1994 | Demartini | |
| 5,394,657 | A | * | 3/1995 | Peterson | 52/12 |
| 5,458,769 | A | | 10/1995 | Johannessen | |
| 5,524,393 | A | | 6/1996 | Nill et al. | |
| 5,526,613 | A | | 6/1996 | Simeone, Jr. | |
| 5,618,416 | A | | 4/1997 | Haefner | |
| 6,428,693 | B2 | | 8/2002 | Singleton | |
| 6,467,105 | B1 | * | 10/2002 | Vanden Elzen | 4/680 |
| 2003/0037498 | A1 | * | 2/2003 | Bishop | 52/302.1 |

OTHER PUBLICATIONS

Catalog Cut, "Raintrol Roof Drains", Jay R. Smith Mfg. Co., (No date).
Catalog Cut, "Series 28600 Flo-Set Roof Drains", Josam Company, (No date).
Catalog Cut, "Flow Controlled Roof Drain with Parabolic Weir", Mifab (No date).
Catalog Cut, "Control-Flow Roof Drains", Tyler Pipe Co. (Wade), (No date).
Catalog Cut, "Large Area Roof Drain with Accutrol Flow Restrictor", Watts Drainage Products, (No date).
Catalog Cut, "Z-105 Control-Flo Roof Drain with Parabolic Weir", Zurn Plumbing Products (No date).
"Acutrol Weir Flow Control", Company Flyer, (c) 2005 Watts Drainage.

* cited by examiner

*Primary Examiner*—Brian E Glessner
*Assistant Examiner*—Adriana Figueroa
(74) *Attorney, Agent, or Firm*—Stiennon & Stiennon

(57) ABSTRACT

A relatively flat roof of a structure is provided with a restricted flow roof drain assembly. The roof drain assembly includes a roof drain extending through an opening in the roof for receiving water collected on the roof. The drain has a predetermined maximum flow rate capacity. A flow restrictor is set on the roof, and surrounds the roof drain. The restrictor has a dam including at least one aperture. The at least one aperture has a variable flow rate capacity which is less than the maximum flow rate capacity of the roof drain.

11 Claims, 4 Drawing Sheets

METHOD FOR PROVIDING EXISTING BUILDING FLAT ROOF WITH DRAIN RESTRICTORS

CROSS REFERENCES TO RELATED APPLICATIONS

This application is a continuation of U.S. application Ser. No. 10/834,586, filed Apr. 29, 2004, now abandoned the disclosure of which is incorporated by reference herein.

STATEMENT REGARDING FEDERALLY SPONSORED RESEARCH

Not Applicable

BACKGROUND OF THE INVENTION

The present invention relates to storm water flow restrictors, and in particular to an external flow restrictor that is easily installed, and has a varying flow rate.

Many buildings have substantially flat roofs which collect storm water during a rainfall. The storm water collected on the roof is typically quickly drained off of the roof through a roof drain. The term "flat roofs" is not limited to a roof that is flat. Even roofs referred to by those skilled in art as a "flat roof" typically have a pitch or low point to direct water collected on the roof to a specific location on the roof or towards a roof edge. The drain generally extends through an opening formed in the roof material at a low point in the roof. The opening must be sealed around the drain to prevent water from leaking through the opening into the building.

The drain is often connected to a storm sewer, or combined sanitary and storm sewer, system provided by a local municipality that can channel the storm water from the roof to a treatment facility or point of discharge. The treatment facility treats the combined storm water and sewage (sewage/water) for safe discharge into the environment, or for use by local citizens. If the sewage/water collected in the sewage system exceeds the treatment capacity of the treatment facility, the sewage/water in the system must be stored until the treatment facility can treat it, or be released untreated into the environment. Unfortunately, releasing untreated sewage/water can cause health problems for the local citizens, and may result in fines from local, state, and federal environmental agencies.

A variety of methods can be employed by the municipalities to avoid releasing untreated sewage/water into the environment. As discussed above, the sewage/water can be stored until the treatment facility can treat it. In one municipality, sewage/water storage facilities, such as tunnels bored in bedrock beneath the municipality's surface was created. However, this method is expensive, and not always an efficient use of taxpayer's dollars in view of the expected heavy rainfalls for a particular climate.

Another method includes increasing the capacity of the treatment facility to handle larger volumes of sewage/water. However, as in building storage facilities for excess sewage/water, building larger facilities is expensive, and the rainfalls which require the larger capacity treatment facilities is an infrequent event which would result in the extra capacity being unused most of the time.

Another method includes shutting off or restricting the flow of storm water into the sewer system. Shutting off the flow of storm water and, arbitrarily restricting the flow of storm water, into the system can result in flooding which is destructive to citizens property and dangerous to the citizens. Restricting the flow of storm water at specific entry points into the system, however, can be an inexpensive and effective way to store storm water until capacity at the treatment facility can accommodate the stored stormed water combined with sewage.

One group of entry points that can be restricted, under specific conditions, without detriment, is roof drains on flat roofs. This method can be accomplished through legislation that requires building owners to restrict the flow of water into roof drains. The storm water collected on the roof can be slowly drained into the sewer system without causing surcharging of the sewer system or flooding on the ground. Collecting storm water on a roof, however, has limitations. Roofs are typically designed to have at least a minimum structural capacity to support an anticipated live roof load that consists of rain, snow, and the like. If the volume of storm water stored on the roof exceeds the structural capacity of the roof, the roof could collapse. Roof drains are typically designed to quickly drain water off of the roof. Fortunately, typical building codes require roofs to have sufficient structural capacity that can support a substantial volume of water in addition to a secondary drain that is independent of the roof drain.

Flow restrictors are available which restrict the flow of storm water into a drain, such as the flow restrictor disclosed in U.S. Pat. No. 3,357,561. This flow restrictor is fixed to a drain sump and is enclosed by a debris guard. The restrictor has a plurality of notches that define a free area that is smaller than the free area of the drain pipe to restrict the flow of water into the drain. As a result, the flow of water into the drain is less than the maximum flow capacity of the drain pipe it is connected to.

The flow restrictor disclosed in U.S. Pat. No. 3,357,561 forms part of the drain assembly that must be at least partially disassembled to change or remove the flow restrictor. Because this type of drain assembly is manufacturer specific, the flow control portion of one drain assembly is not compatible with a drain assembly provided by a different manufacturer. As a result, if a flow restrictor is required for an existing drain, the entire drain assembly must be replaced. Replacing the drain assembly requires disassembling the existing drain, and often requires replacing the sump with a new sump that can accommodate the flow restrictor. Replacing a sump requires breaking the seal between the sump and the roof material. This can often result in leaks if the seal to the new sump is not properly installed, and may void roof warranties. Moreover, disassembling the old drain can be time consuming and expensive. Accordingly, a need exists for a flow restrictor which universally fits all roof drains, and does not require disassembling or replacing an existing drain.

SUMMARY OF THE INVENTION

The present invention provides a restricted flow roof drain assembly for use on a relatively flat roof of a structure. The roof drain assembly includes an exiting roof drain extending through an opening in the roof for receiving water collected on the roof. The drain has a predetermined maximum flow rate capacity. A flow restrictor is set on the roof, and surrounds the roof drain. The restrictor has a dam including at least one aperture. The at least one aperture has a variable flow rate capacity that is less than the maximum flow rate capacity of the roof drain.

A general objective of the present invention is to provide a restricted flow roof drain assembly having a flow restrictor that is easy to install. This objective is accomplished by providing a flow restrictor which can be set on the roof surrounding the roof drain to restrict the flow of water into the roof drain without disassembling the roof drain, or disturbing openings in the roof which can cause leaks.

This and still other objects and advantages of the present invention will be apparent from the description that follows. In the detailed description below, preferred embodiments of the invention will be described in reference to the accompanying drawings. These embodiments do not represent the full scope of the invention. Rather the invention may be employed in other embodiments. Reference should therefore be made to the claims herein for interpreting the breadth of the invention.

DETAILED DESCRIPTION OF THE INVENTION

Figure 1:
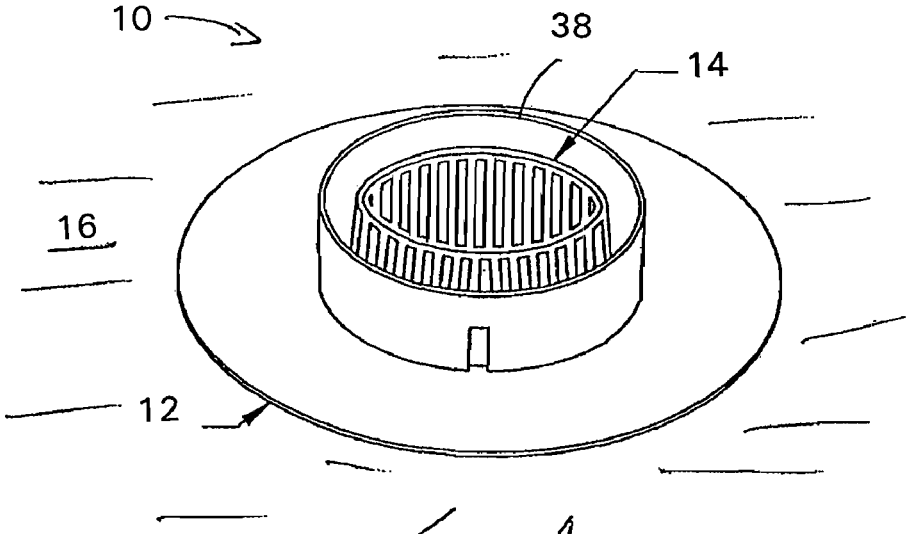
FIG. 1 is a perspective view of a restricted flow roof drain assembly incorporating the present invention.
Figure 2:
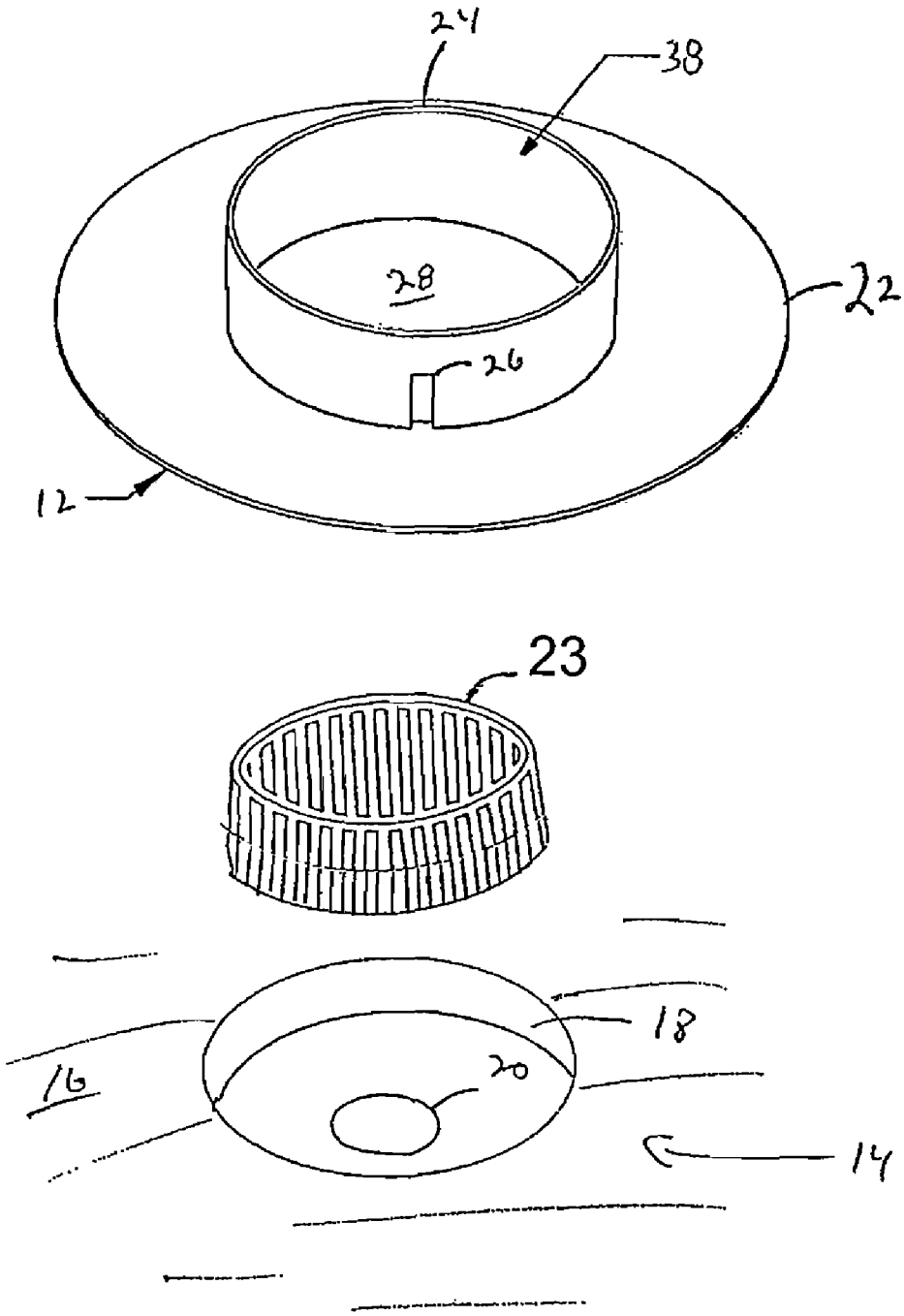
FIG. 2 is an exploded perspective view of the roof drain assembly of FIG. 1.

A restricted flow drain assembly 10, shown in FIGS. 1 and 2, includes an external flow restrictor 12 surrounding a roof drain 14. The flow restrictor 12 is set on a relatively flat roof 16 of a building, and surrounds the roof drain 14 to restrict the flow of water into the drain. Advantageously, the flow restrictor 12 can be placed around the roof drain 14 without disassembling, or disturbing, the drain 14 or attaching to, or puncturing, the roof 16.

The roof drain 14 can be any conventional drain with, or without, a sump 18 fixed to a drain pipe 20 extending through the roof 16 of a building, or other structure. The roof 16 is sealed around the sump 18 that guides water collected on the roof 16 during a rainfall into the drain pipe 20. An optional debris guard 23 fixed to the sump 18 can be provided to block debris from entering the drain pipe 20. An internal flow restrictor, such as disclosed in U.S. Pat. No. 3,357,561 which is fully incorporated herein by reference, can also be fixed to the sump beneath the debris guard 23 without departing from the scope of the invention.

The drain 14 has a maximum flow rate, which in most conventional drains is determined by the internal diameter of the drain pipe 20 or connection of the drain pipe 20 to the sump 18. However, in drains having internal flow restrictors, the maximum flow rate of the drain may be limited by the maximum flow rate of the internal flow restrictor.

The external flow restrictor 12 is set on the roof 16 surrounding the roof drain 14 to restrict the flow of water entering the drain 14. Advantageously, to provide simple and easy installation, the external flow restrictor 12 is supported by the roof 16, and is not attached to the drain 14. Moreover, the external flow restrictor 12 is not fixed to the roof 16 using fasteners or other mechanisms which can puncture the roof 16 and cause roof leaks.

Figure 3:
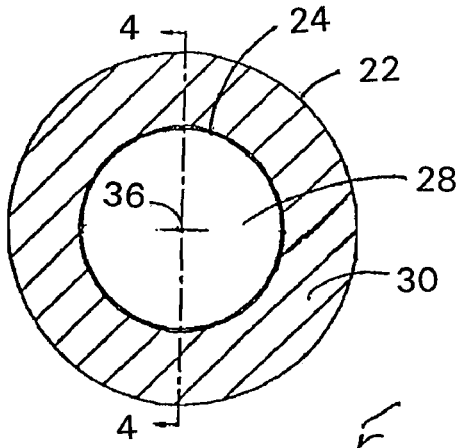
FIG. 3 is a top view of the external flow restrictor of FIG. 2.
Figure 4:
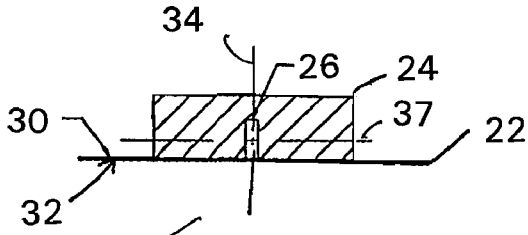
FIG. 4 is a cross sectional view along line 4-4 of the flow restrictor of FIG. 3.

As shown in FIGS. 2-4, the external flow restrictor 12 includes an annular base 22, a cylindrical dam 24 extending substantially perpendicularly from the base 22, and at least one aperture 26 formed in the dam 24. The annular base 22 defines a central opening 28 having a diameter that defines an inner perimeter surrounding the drain 14, and has a top surface 30 and a bottom surface 32. Preferably, the base is formed ¼ inch steel plate in order to ensure the external flow restrictor has sufficient weight to resist weather conditions, such as high winds, from inadvertently moving the flow restrictor. The bottom surface 32 engages the roof 16, and distributes the weight of the external flow restrictor 12 across the surface area of the bottom surface 32 to avoid damaging the roof 16.

The central opening 28 of the base 22 defines a free area that is at least equal to the free area of the drain 14, such that the central opening 28 does not restrict the flow of water into the drain 14. The free area is the total area used to calculate the maximum flow rate. Preferably, the central opening 28 has a free area that is greater than the free area of the drain, such that the maximum flow rate through the central opening 28 is greater than the maximum flow rate of the drain 14.

The cylindrical dam 24 extends substantially upwardly from the base top surface 30, and blocks water from flowing toward the drain 14. Preferably, the dam 24 is concentrically located with the base central opening 28, and the inside diameter of the dam 24 is substantially equal to the central opening diameter to minimize material costs. However, the dam inner diameter can be greater than the opening diameter, such that the base 22 extends both radially inwardly and radially outwardly from the dam 24 without departing from the scope of the claims. Although a cylindrical dam 24 is disclosed, the dam 24 can be any shape that blocks water from flowing toward the drain 14, such as a square, rectangular, oval, or irregularly shaped, and the like, without departing from the scope of the invention.

The dam 24 is preferably formed from steel plate to increase the weight of the flow restrictor 12, and have sufficient strength to withstand water pressure acting on the dam 24. The dam 24 is fixed to the base 22 using methods known in the art for joining materials, such as welding, bolting, and the like. Preferably, the junction between the dam 24 and base 22 is sealed to prevent water from flowing through the juncture. The juncture can be sealed by the weld material if the dam 24 is welded to the base 22, or caulked, depending upon the method used to join the dam 24 and base 22. Of course, if the juncture is not sealed, the free area of the juncture must be taken into account when selecting the size and number of apertures in the dam.

The aperture 26 formed in the dam 24 allows water to flow past the dam 24 and into the drain 14 at a predetermined rate that is less than the maximum flow rate of the drain 14. Obviously, if the flow rate past the dam 24 through the aperture 26 is less than the maximum flow rate of the drain 14, and the central opening 28 in the annular base 22 surrounds the drain 14, the flow rate past the dam 24 through the aperture 26 is also less than the flow rate through the opening 28. The size and number of apertures formed in the dam depends upon the total desired flow rate of fluid through all of the apertures into the drain 14, the flow capacity of the roof drain 16, and structural live load allowed by the local building code. Preferably, at least two apertures are formed in the dam.

The rectangular aperture 26 (best shown in FIG. 4) forms a compound hydraulic opening which provides an increasing flow rate past the dam 24, as the depth of the water on the roof 16 increases. The aperture 26 has a major axis 34 that is substantially parallel to the annular axis 36, and a minor axis 37 substantially perpendicular to the annular axis 36. When the aperture 26 is not fully submerged in water, it acts as a vertical, standard contracted weir that slowly drains the roof 16. As the water on the roof 16 increases in depth, the flow rate through the aperture 26 increases until the aperture 26 is fully submerged. Once the aperture 26 is fully submerged, it becomes an orifice having a flow rate which is greater than a standard contracted weir to drain the roof 16 at an even higher rate that is still considerably less than the maximum flow rate of the roof drain 16.

The cylindrical dam 24 has an open top 38 which provides a safety bypass over the dam 24, and allows water to flow past the dam 24 unrestricted once the water level has reached a predetermined maximum depth. The dam height determines the desired maximum depth of standing water on the roof 16, and depends upon the structural capacity of the roof 16 to support a fixed volume of water. Preferably, the open top 38 provides a water flow rate which is at least equal to the drain maximum flow rate to quickly drain the roof 16 prior to exceeding the structural capacity of the roof 16.

The flow restrictor 12 is installed by clearing an area of the roof 16 around the drain 14, and then setting the restrictor 12 on the roof 16, such that the drain 14 is surrounded by the flow restrictor 12. Advantageously, attaching the flow restrictor 12 to the drain 14 or roof 16 using mechanical fasteners which requires tools or penetrating the roof 16 are not required. The weight of the flow restrictor 12 presses down against the roof material providing a press or friction seal to the roof 16. Although caulking around the base circumference is not required, caulking can be applied to the junction between the base 22 and roof 16 to seal the flow restrictor 12 to the roof, if desired, without departing from the scope of the invention. Because the flow restrictor 12 is not physically attached to the roof 16 or roof drain 14, easy removal of the flow restrictor 12 is permitted in case roof repairs are required.

In use, the flow restrictor 12 restricts the flow of water off of a roof 16 into the drain 14, such that the water flowing through the aperture 26 past the dam 24 into the drain 14 is less than the maximum flow capacity of the drain 14. As the water on the roof 16 increases in depth, the flow rate through the aperture 26 increases due to the vertically oriented rectangular shape of the aperture 26. If water continues to collect on the roof 16 at a rate which exceeds the flow rate of water past the dam 24, the water level rises to completely submerge the aperture 26 which results in an even greater flow rate through the aperture 26 which is less, however, than the maximum flow rate capacity of the drain 14. If water continues to collect on the roof 16 at a rate which exceeds the flow rate of the submerged aperture 26, the water level will rise until the water spills over the dam 24 through the dam open top 38 directly into the drain 14 until the flow rate past the dam 24 (i.e. through the aperture and the dam top) equals the maximum flow rate capacity of the drain 14.

Figure 5:
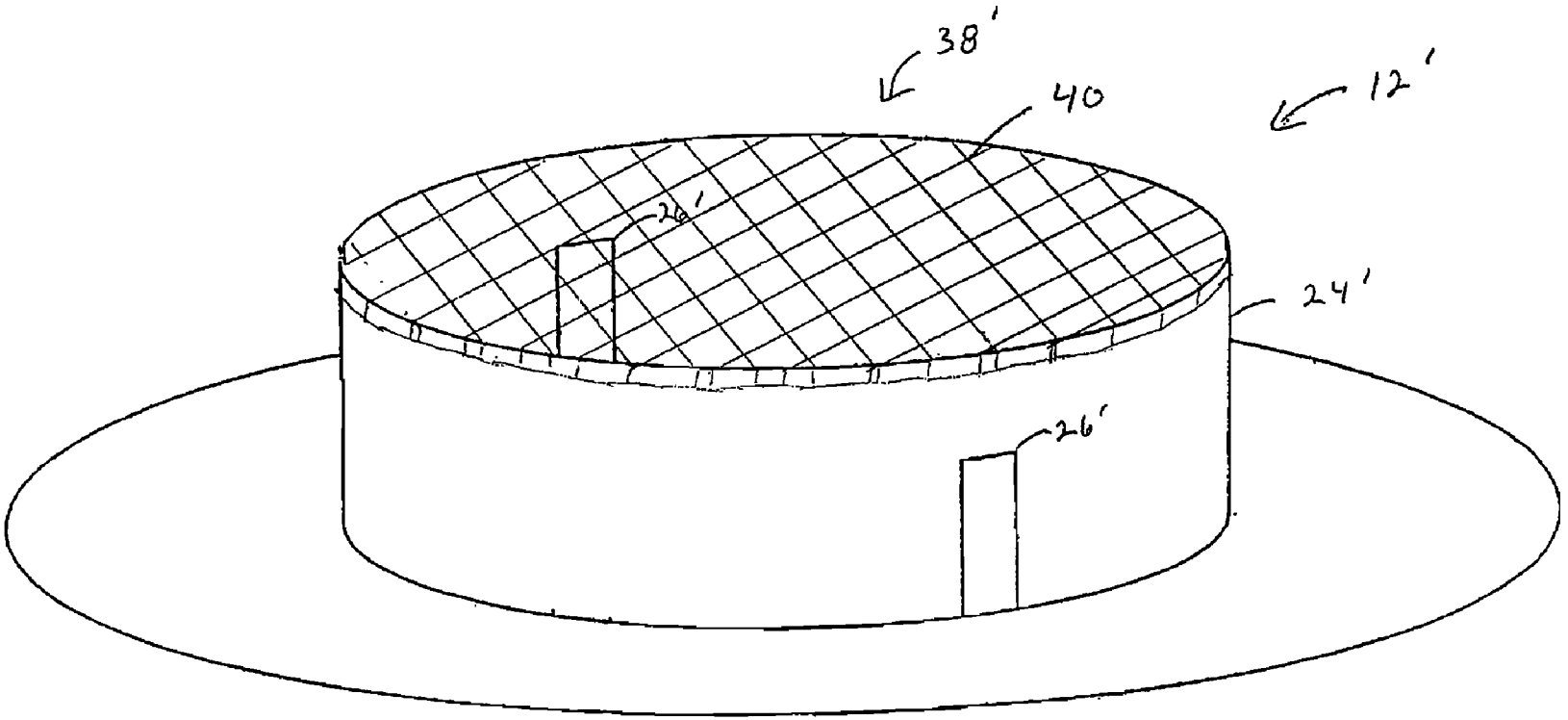
FIG. 5 is an alternative external flow restrictor incorporating the present invention.

In an alternative flow restrictor 12', shown in FIG. 5, the dam 24' includes more than one aperture 26'. The flow restrictor dam 24' comprises an upwardly extending continuous wall for encirclement of the roof drain, the wall extending upwardly from a base to a top 38' in an upward direction, wherein the top of the wall defines an overflow opening, the wall having a peripheral direction which extends along the surface of the wall perpendicular to the upward direction. Portions of the wall define a plurality of apertures 26' passing through the wall, the apertures extending upwardly in the wall. Each aperture has a height in the upward direction, and the height of each aperture is less than a distance between said aperture and the closest aperture measured along the peripheral direction of the wall. A flange extends radially outwardly from the base of the wall for positioning over the relatively flat roof. The dam 24' has a debris guard 40. The debris guard 40 can be fixed to the flow restrictor 12' to guard the open top 38' from debris, such as leaves, stones, paper, and the like. Preferably, the debris guard 40 has a free area that is at least greater than the free area of the drain 14 to prevent the guard 40 from restricting the flow of water below the maximum flow rate of the drain 14. Of course, the free area of the debris guard 40 can be less than the free area of the drain 14 without departing from the scope of the invention. In the embodiment shown in FIG. 5, the debris guard 40 covers only the dam open top 38', and is a wire mesh which also prevents animals from entering the drain 14 through the dam top 38'. The debris guard 40, however, can be formed from a stamping, cast, molded, formed as an integral part of the dam, and the like, and can cover the apertures without departing from the scope of the invention.

Figure 6:
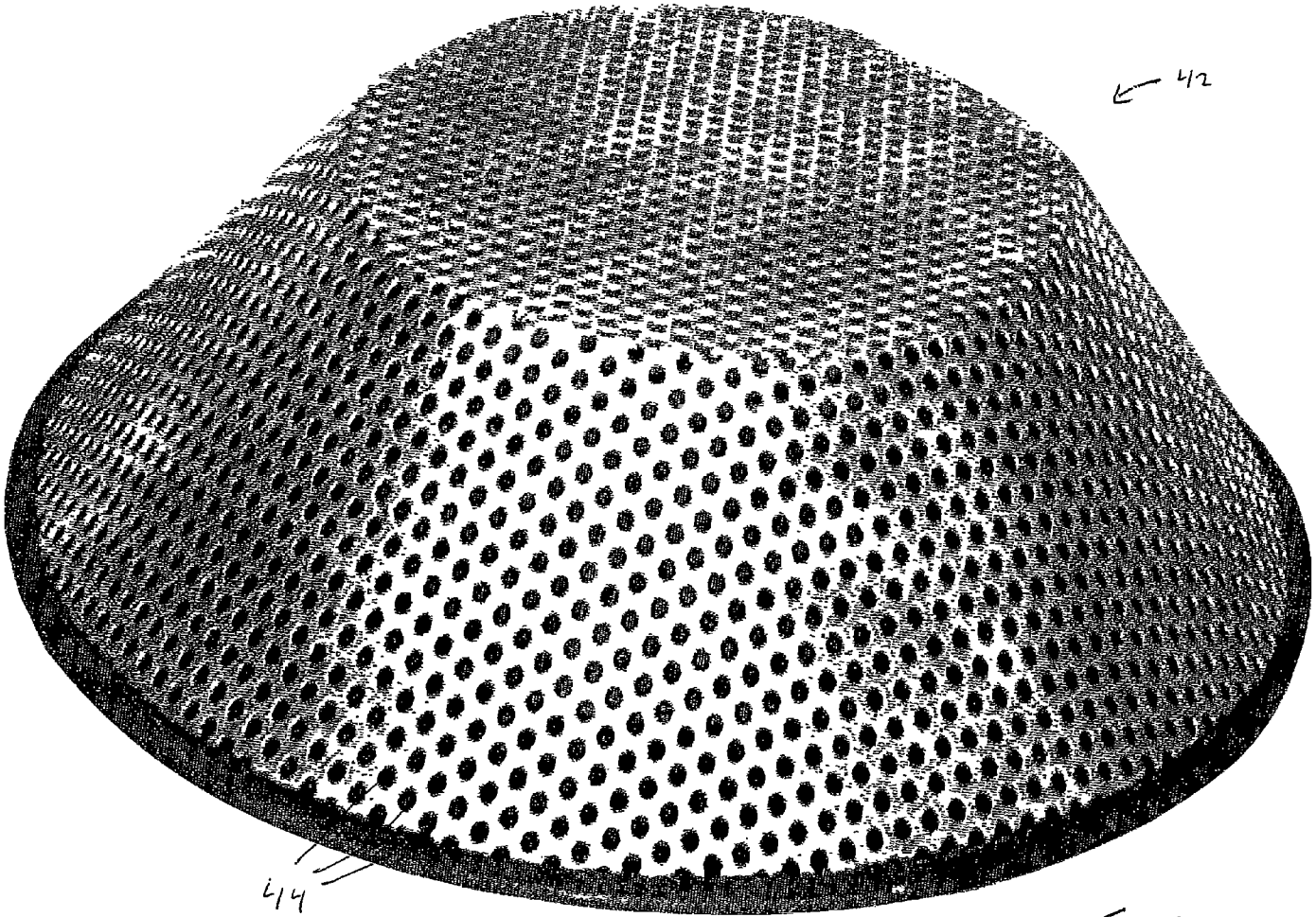
FIG. 6 is another alternative flow restrictor incorporating the present invention.

In yet another embodiment shown in FIG. 6, a flow restrictor 12, such as disclosed above in FIG. 2, is covered by a debris guard 42 that is placed over the flow restrictor 12 to cover both the flow restrictor open top 38 and the apertures 26. The debris guard 42 can be formed from any methods known in the art, such as stamping, casting, and the like, and includes a plurality of openings that define a free area through with the water flows. As in the debris guard 40 shown in FIG. 5, preferably, the debris guard 42 shown in FIG. 6 has sufficient openings 44, such that the debris guard 42 has a free area that is at least greater than the free area of the drain 14 to prevent the strainer 42 from restricting the flow of water below the maximum flow rate of the drain 14. Of course, the free area of the debris guard 42 can be less than the free area of the drain 14 without departing from the scope of the invention.

While there has been shown and described what are at present considered the preferred embodiments of the invention, it will be obvious to those skilled in the art that various changes and modifications can be made therein without departing from the scope of the invention defined by the appended claims.

We claim:

1. A method for providing flow restrictors for a substantially flat roof with existing roof drains, comprising the following steps:

locating an existing roof drain on a substantially flat roof; and setting a flow restrictor directly on the roof, the flow restrictor having a flange with an upwardly extending wall connected thereto and having portions defining at least one rectangular aperture passing through the wall, the aperture extending upwardly a first distance in the wall, and the wall extending upwardly from a base to a top, wherein the top of the wall defines an overflow opening and wherein the flange encircles the wall and extends at least a second distance radially outwardly from the base of the wall, wherein the step of setting the flow restrictor on the roof comprises positioning the flow restrictor on the roof so the wall surrounds the roof drain and any drain guard associated with said roof drain, such that the flow restrictor does not overlie the roof drain and any drain guard associated therewith, the so placed flow restrictor serving to restrict the flow of water entering the drain such that the flow restrictor is supported directly by the roof, and is not attached to the drain or fixed to the roof using fasteners which can puncture the roof and cause roof leaks.

2. The method of claim 1 wherein the flow restrictor wall has an upward direction extending between the base and the top, and the wall has a peripheral direction which extends along the surface of the wall perpendicular to the upward direction, and wherein the wall has a plurality of apertures extending upwardly in the wall, wherein each aperture has a height in the upward direction, and wherein the height of each aperture is less than a distance between said aperture and the closest aperture measured along the peripheral direction of the wall.

3. The method of claim 1 wherein the flow restrictor flange is formed of a steel plate.

4. The method of claim 2 wherein the flow restrictor flange is formed of a steel plate.

5. A method for providing flow restrictors for a substantially flat roof with existing roof drains, comprising the following steps:

locating an existing roof drain on a substantially flat roof which has an upwardly protruding drain guard; and setting a flow restrictor on the roof, the flow restrictor having a wall which is connected to and which extends upwardly from an encircling flange, the wall having portions defining at least one rectangular aperture passing through the wall, the aperture extending upwardly a first distance in the wall, and the wall extending upwardly from a base to a top, wherein the top of the wall defines an overflow opening and the flange is unperforated and extends at least a second distance radially outwardly from the base of the wall, wherein the second distance is greater than the first distance, wherein the step of setting the flow restrictor on the roof comprises positioning the flow restrictor on the roof to surround the drain guard of the roof drain to restrict the flow of water entering the drain such that the flow restrictor is supported by the roof, and is not attached to the drain or fixed to the roof using fasteners which can puncture the roof and cause roof leaks.

6. The method of claim 5 wherein the flow restrictor wall has an upward direction extending between the base and the top, and the wall has a peripheral direction which extends along the surface of the wall perpendicular to the upward direction, and wherein the wall has a plurality of apertures extending upwardly in the wall, wherein each aperture has a height in the upward direction, and wherein the height of each aperture is less than a distance between said aperture and the closest aperture measured along the peripheral direction of the wall.

7. The method of claim 5 wherein the flow restrictor flange is formed of a steel plate.

8. The method of claim 6 wherein the flow restrictor flange is formed of a steel plate.

9. A method for providing flow restrictors for a substantially flat roof with existing roof drains, comprising the following steps:

locating an existing roof drain on a substantially flat roof; and setting a flow restrictor on the roof to surround the roof drain, the flow restrictor having an upwardly extending continuous wall for encirclement of the roof drain, the wall being connected to an encircling flange, and extending upwardly from a base to a top in an upward direction, wherein the top of the wall defines an overflow opening, the wall having a peripheral direction which extends along the surface of the wall perpendicular to the upward direction, and wherein portions of the wall define a plurality of like rectangular apertures passing through the wall, the apertures extending upwardly in the wall, wherein each aperture has a height in the upward direction, and wherein the height of each aperture is less than a distance between said aperture and the closest aperture measured along the peripheral direction of the wall, and the flange extends radially outwardly from the base of the wall, wherein the step of setting the flow restrictor on the roof comprises positioning the flow restrictor on the roof to surround the roof drain to restrict the flow of water entering the drain such that the flow restrictor is supported by the roof, and is not attached to the drain or fixed to the roof using fasteners which can puncture the roof and cause roof leaks.

10. The method of claim 9 wherein the flow restrictor flange is formed of an unperforated steel plate.

11. The method of claim 9 wherein the flow restrictor upwardly extending wall apertures extend upwardly a first distance in the wall, and wherein the flange extends at least a second distance radially outwardly from the base of the wall, wherein the second distance is greater than the first distance.

* * * * *